US005373925A

United States Patent [19]

Handford et al.

[11] Patent Number: 5,373,925

[45] Date of Patent: Dec. 20, 1994

[54] DIVING APPARATUS

[75] Inventors: Roger J. Handford; Malcolm Johnson, both of North Cheam, Great Britain

[73] Assignee: Ocean Technical Services Limited, Surrey, United Kingdom

[21] Appl. No.: 30,269

[22] PCT Filed: Oct. 8, 1991

[86] PCT No.: PCT/GB91/01746

§ 371 Date: Apr. 6, 1993

§ 102(e) Date: Apr. 6, 1993

[87] PCT Pub. No.: WO92/05999

PCT Pub. Date: Apr. 16, 1992

[30] Foreign Application Priority Data

Oct. 9, 1990 [GB] United Kingdom ..... 9021925

[51] Int. Cl.[5] ..... H02G 11/02; B63C 11/34

[52] U.S. Cl. ..... 191/12.2 A; 114/315; 242/390.6; 242/390.2; 242/418

[58] Field of Search ..... 191/12.2 R, 12.2 A, 191/12.4; 405/185; 114/315; 242/54 R, 86, 86.1, 86.2, 86.51

[56] References Cited

U.S. PATENT DOCUMENTS

| | | | |
|---|---|---|---|
| 2,781,456 | 2/1957 | Buckeridge | 191/12.2 A X |
| 3,168,261 | 2/1965 | Hainer . | |
| 4,150,798 | 4/1979 | Aragon | 191/12.2 R X |
| 4,217,066 | 8/1980 | Gunther | 405/185 |
| 4,581,497 | 4/1986 | Morrison et al. | 191/12.2 R |
| 4,583,700 | 4/1986 | Tschurbanoff | 242/86.51 |
| 4,646,987 | 3/1987 | Peterson | 191/12.2 A X |
| 4,669,145 | 6/1987 | Kehr . | |
| 4,743,175 | 5/1988 | Gilmore . | |
| 5,034,571 | 7/1991 | Galloway | 191/12.2 A |
| 5,067,920 | 11/1991 | Brisky | 114/315 X |
| 5,230,588 | 7/1993 | Wittke et al. | 405/185 X |
| 5,263,431 | 11/1993 | Wood | 242/54 R X |

FOREIGN PATENT DOCUMENTS

| | | | |
|---|---|---|---|
| 1284097 | 1/1962 | France . | |
| 2604697 | 4/1988 | France . | |
| 487568 | 6/1938 | United Kingdom . | |
| 993992 | 6/1965 | United Kingdom . | |
| 1093879 | 12/1967 | United Kingdom . | |
| 1523163 | 8/1978 | United Kingdom . | |
| 2182967A | 5/1987 | United Kingdom . | |
| 47806 | 6/1978 | U.S.S.R. | 191/12.2 A |
| 1603470 | 10/1990 | U.S.S.R. | 191/12.2 A |

*Primary Examiner*—Michael S. Huppert
*Assistant Examiner*—Scott L. Lowe
*Attorney, Agent, or Firm*—Richard C. Litman

[57] ABSTRACT

An underwater deployment and storage apparatus for a diving bell or the like has a reel assembly (7) with spaced flanges (9,10) to contain an umbilical services assembly (5) wound around a hub (7A) of the reel. A rotary union (12) mounted in the hub has a fixed assembly or static line (11) about which the hub rotates. The fixed assembly receives services such as gases, liquids, electricity, fibre optics and the like and feeds to a rotatable assembly connected with the hub. The umbilical services are coupled to one of the umbilical. A first drive motor rotates the reel in either direction. A second drive motor and fairlead (6) extract from or rewind the umbilical onto the reel. Both drive motors are synchronized under controls to exert and maintain either a tractive or a drag force on the run of the umbilical.

21 Claims, 7 Drawing Sheets

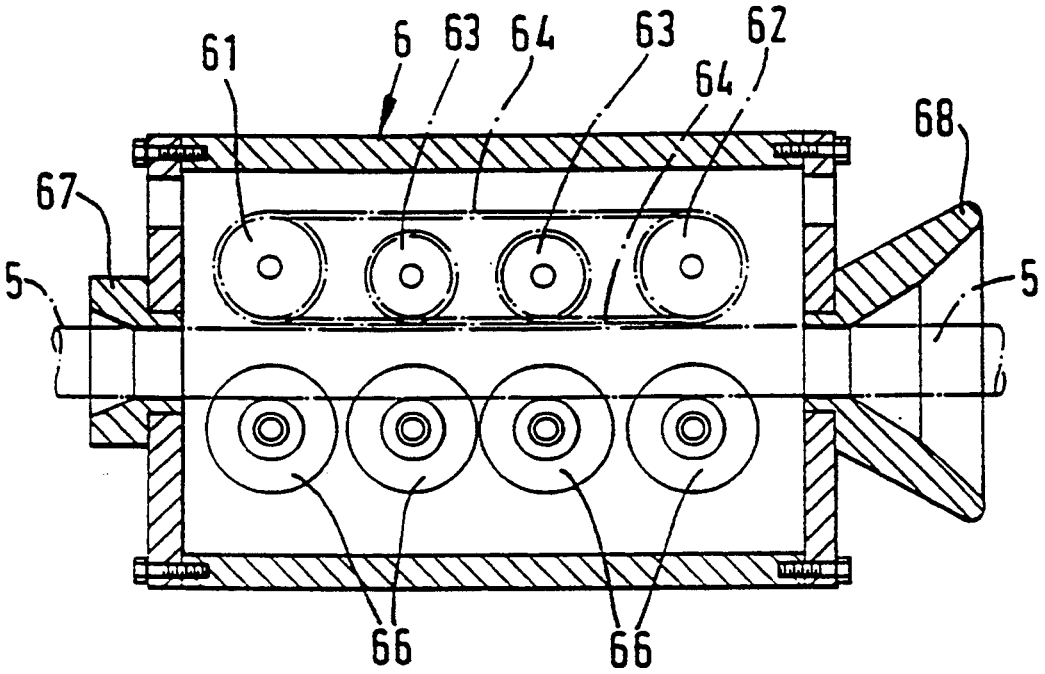
FIG. 5
FIG. 6
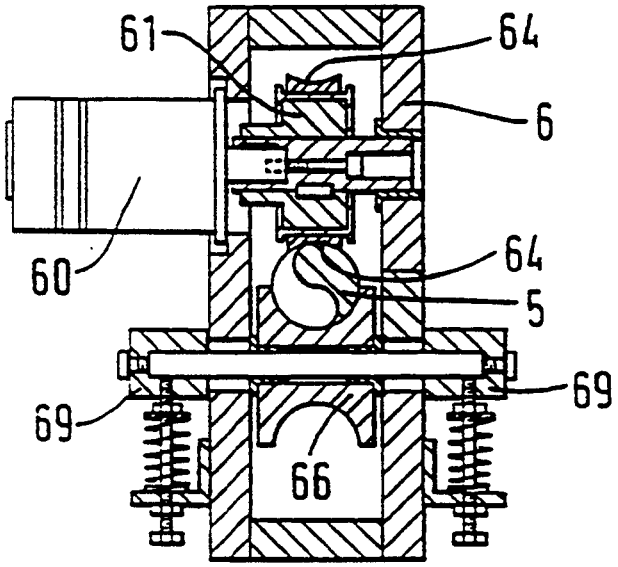

DIVING APPARATUS

BACKGROUND OF THE INVENTION

1. Field of the Invention

This invention relates to diving apparatus.

2. Description of the Prior Art

This invention is primarily, but not essentially, concerned with commercial air breathing diving at depths down to 50 m and apparatus such as are disclosed in British Application GB 2182967A to David W. Kirkley et al., and published on May 28, 1987.

SUMMARY OF THE INVENTION

In diving operations life-support and other required services are supplied to a diver by means of an "umbilical" comprising a flexible bundle of ducts and cables paid out from a diver deployment device or surface support station. Such a system is not ideal.

This invention seeks to provide an apparatus for storage and feed or retraction of an umbilical under diver control and for sub-aqua deployment.

According to this invention there is provided a deployment, retrieval and storage apparatus for an umbilical, said apparatus comprising a reel with spacer flanges to contain the umbilical assembly wound around a hub of the reel, a rotary union mounted in the hub having a fixed assembly about which the hub rotates, said assembly receiving services and feeding same to a rotatable assembly connected with the hub and coupling said services to one end of the umbilical, first drive means to rotate the reel, second drive means coupled with a fairlead for driving the umbilical for deployment or retrieval, both said drive means being coupled and controlled so that a substantially constant tractive or drag force is exerted and maintained on the umbilical between the fairlead and reel. Both during extraction from and rewinding onto the reel.

This invention provides including the aforesaid apparatus mounted on a diving bell or the like.

The rotary union preferably comprises a first unit providing fluid line connections for gases and liquids and a second unit integral therewith providing electrical and/or fibre optic connections. The two units are typically positioned on the hub axis in end to end relationship.

The reel flanges may be spaced to provide a monospiral winding or alternatively the reel flanges are spaced to provide a multi-turn multi-layer arrangement with three windings being an advantageous width.

The drive means may use hydraulic motors under control of the diver who may have advance or retract control selection, alternatively air or electrical drives could be used.

It has been found in practice that a tractive force needs to be applied between the fairlead and reel as well as providing drive through the fairlead. One means for achieving this, broadly, uses a hydraulic circuit giving proportional control with flow being divided between the first reel drive means and the second fairlead drive means. The fairlead motor drive has a torque control system whereby the constant tractive force pulling against the reel motor drive drag is provided during unwinding with a smaller tractive drag against the reel motor drive being provided during reeling-in.

Control means may be provided which adjusts. continuously or step-wise, the speed of the reel according to the instantaneous wound umbilical diameter.

In practice it has been found important to provide the two drive means which are co-ordinated to provide the required power to overcome drag and friction without overstressing either the apparatus or the umbilical.

Encoding means may be included to determine the extracted length of the umbilical for control or monitoring purposes.

BRIEF DESCRIPTION OF THE DRAWINGS

The accompanying drawings illustrate embodiments by way of examples and are described hereinafter in outline, i.e., various features of construction and operation are clearly shown on the drawings and are therefore not described in detail.

In the drawings:

FIG. 5 shows a longitudinal sectional view through a modified fairlead, FIG. 6 shows a transverse section through the fairlead of FIG. 5.

DETAILED DESCRIPTION OF THE PREFERRED EMBODIMENTS

The primary purpose of the present invention is to provide an arrangement for supplying divers with a variety of services and life support systems to facilitate their work many meters from a diving bell or the like using an umbilical arrangement. To prevent hazardous situations arising the umbilical is under control of the diver and may be stowed or paid-out in response to a command given by the diver. A secondary means of control may be made available to a supervisor at the surface.

Figure 1:
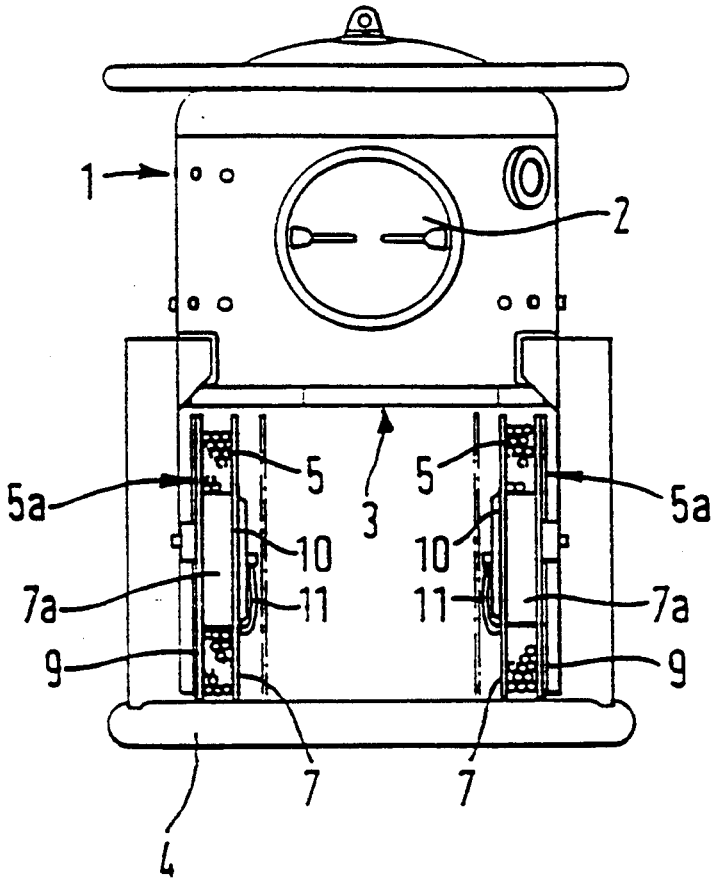
FIG. 1 shows two umbilical reeling apparatus on a wet diving bell, and in front elevation.
Figure 2:
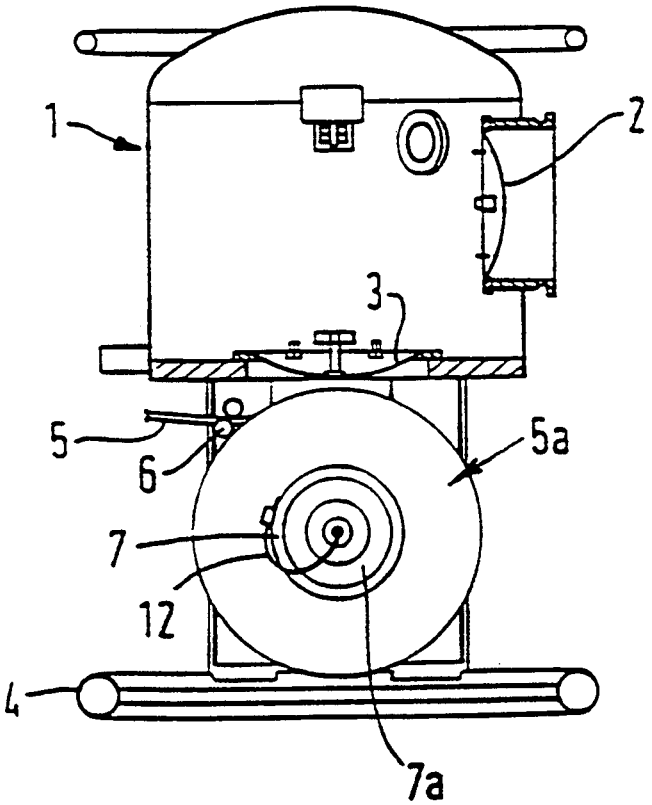
FIG. 2 shows a side elevational view of the apparatus of FIG. 1.

Referring to FIGS. 1 and 2 of the drawings these show a wet diving bell similar to that described and claimed in GB 2182967A. The diving bell 1 includes closable access apertures 2 and 3 with a support structure 4 depending beneath the floor of the bell. To facilitate the divers carrying out their tasks an umbilical assembly 5*a* is provided through which various fluids and gases can be conveyed together with electric signals for communications. The umbilical 5 passes through a fairlead 6 and is wound up on a rotatable reel assembly 7. Two such assemblies with individual umbilicals are provided to serve two divers associated with the bell 1. Each of the reels has side flanges 9 and 10 between which the umbilical may be wound around the hub 7*a* providing for a width which accommodates three turns. Services to the diver are fed via a static line or fixed assembly 11 into the centre of the reel hub and by means of a suitable rotating union the services pass to coupling 12 which feeds the end of the umbilical 5.

Figure 3:
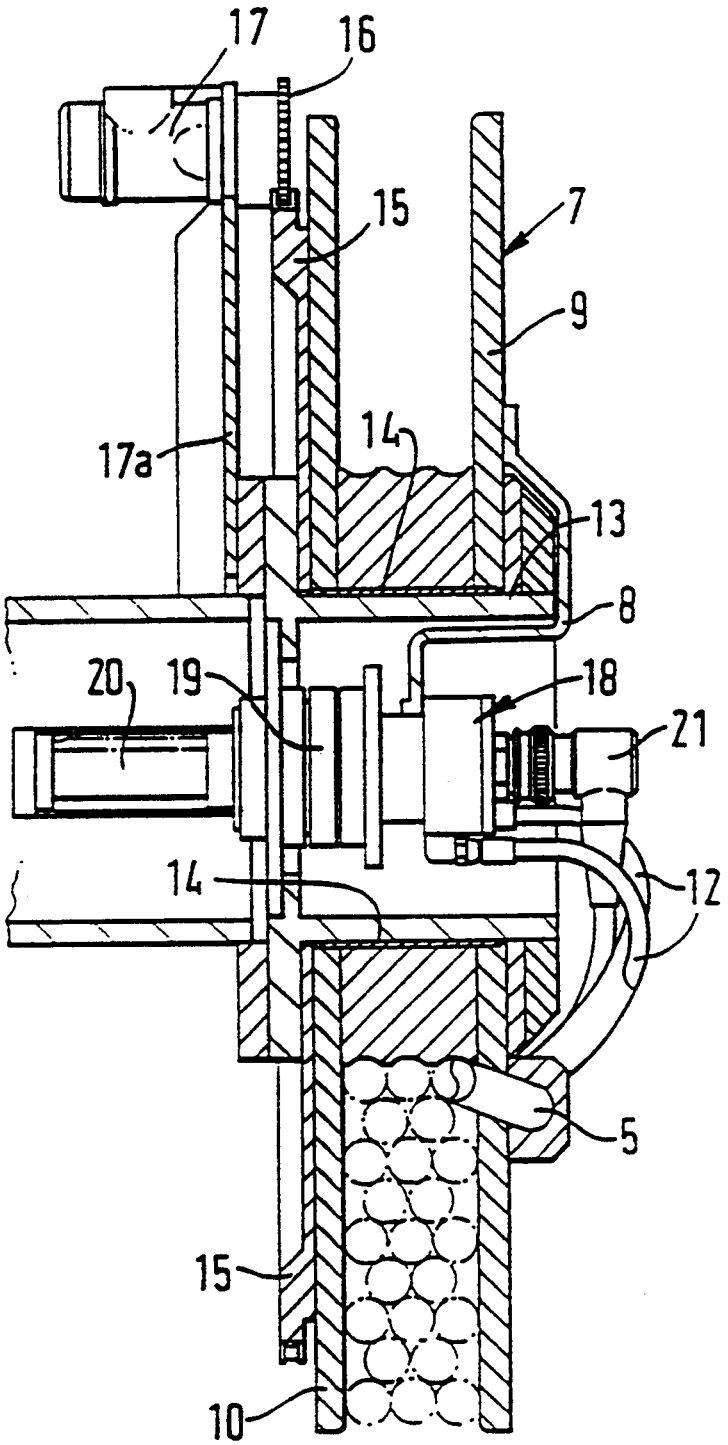
FIG. 3 shows a sectional detail through one reel.
Figure 4:
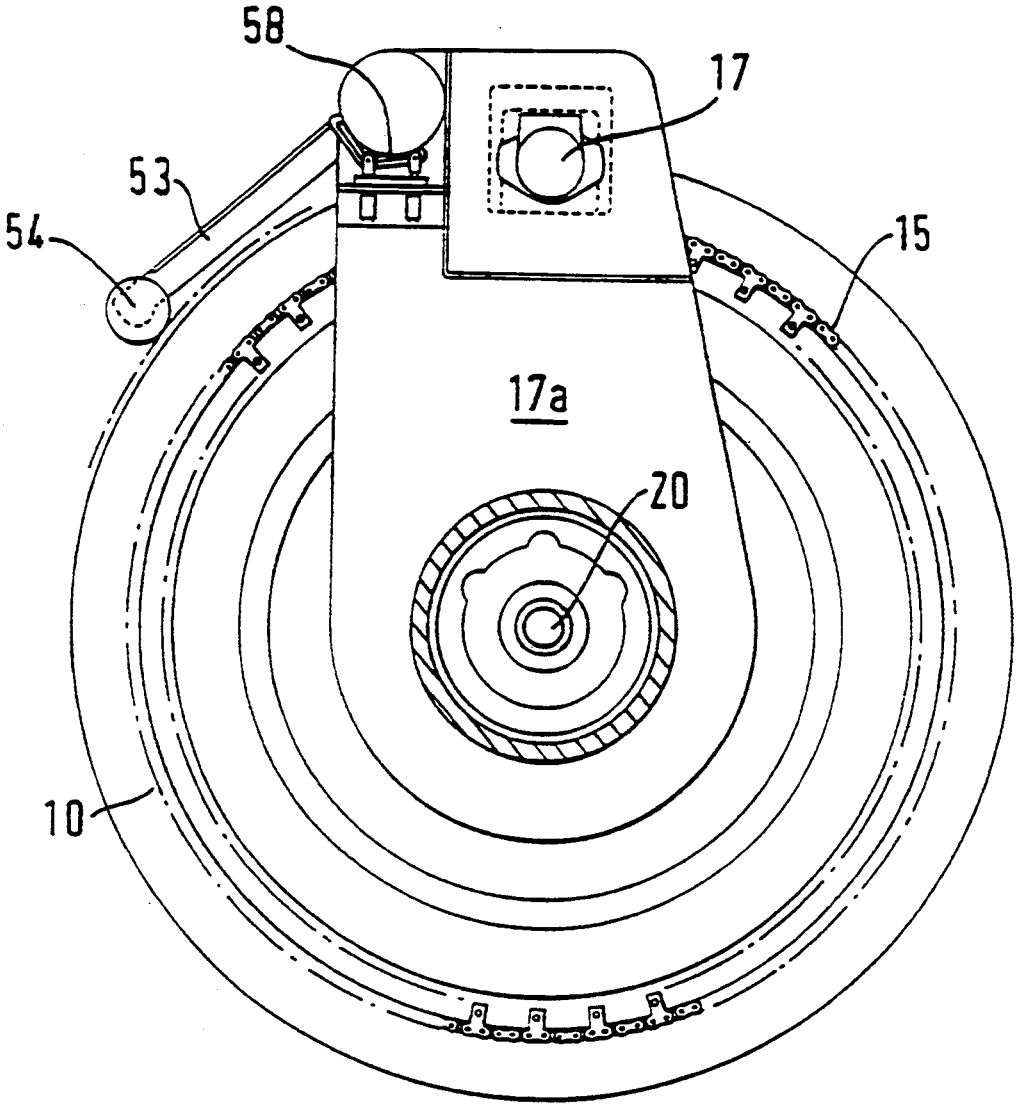
FIG. 4 shows a side view of the reel shown in FIG. 3.

Referring to FIGS. 3 and 4 of the drawings, the reel assembly 7 is rotatably mounted on a fixed central hub 13 which is suitably secured to the platform structure 4. Between the inner periphery of the hub and the hub 13 a bearing 14 is provided. To the inner flange 10 of the reel a sprocket wheel 15 is attached and this is engaged by a sprocket or pinion gear 16 powered by a first drive means constituted by a hydraulic motor 17 mounted on support 17*a* secured to the fixed hub 13. A hub member 8 has an outer flange portion secured to the outer flange 9 of the reel and an inner flange portion carries the rotating part of the rotary union 18. This union 18 includes feed segments 19 each of which communicate with fixed couplings for the supply of fluid to thereafter communicate with the lines 12 which rotate with the first rotary union 18 and which supply the umbilical 5. Mounted on the same axis as the part 18 is a second rotary union 20 which serves to supply electrical connections to a coupling 21 again mounted on the first rotary union 18. By this means both fluid and electrical connections can be passed from fixed conduits and cables secured to the platform structure 4 to feed the end of the rotating umbilical 5 wound on the reel. As shown in FIG. 4, a pivoted arm 53 having a roller 54 at one end engages the outer periphery of the umbilical and associated with the arm 53 is a limit switch assembly 58 which is preset so as to detect an upper and lower limit for the roller 54 whereby the drive may be shut off when the umbilical is either fully wound on to the reel or fully extracted.

In a further embodiment (not shown) the switch assembly 58 is replaced by a proportional sensing device which is able to determine the diameter of the stored umbilical on the reel at any instant and thereby indicate the amount which has been run out. In yet another embodiment the roller assembly, or similar arrangement, may be used to determine the peripheral diameter and thus to control the motor speed to provide a constant rate of paying out or reeling in the umbilical.

FIGS. 5 and 6 show the fairlead drive means which has a guide cone 67 adjacent the reel and through which the umbilical 5 passes. The umbilical extends through the fairlead and passes out through a wider bell shaped guide 68. The umbilical is driven by a hydraulic motor 60 which rotates a pulley 61 driving a belt or band 64 extending around a further tensioning pulley 62. The belt has a concave surface engaging the umbilical 5. Idler wheels 63 are provided positioned between the pulleys 61 and 62 thereby to provide good frictional contact between the drive belt 64 and the outer periphery of the umbilical 5. In order to maintain contact between the umbilical and the belt further spring loaded pulleys 66 are provided each having an arcuate circumference corresponding to the outer circumference of the umbilical 5 and each further being urged by spring loaded carriers 69 into firm contact with the umbilical.

Figure 7:
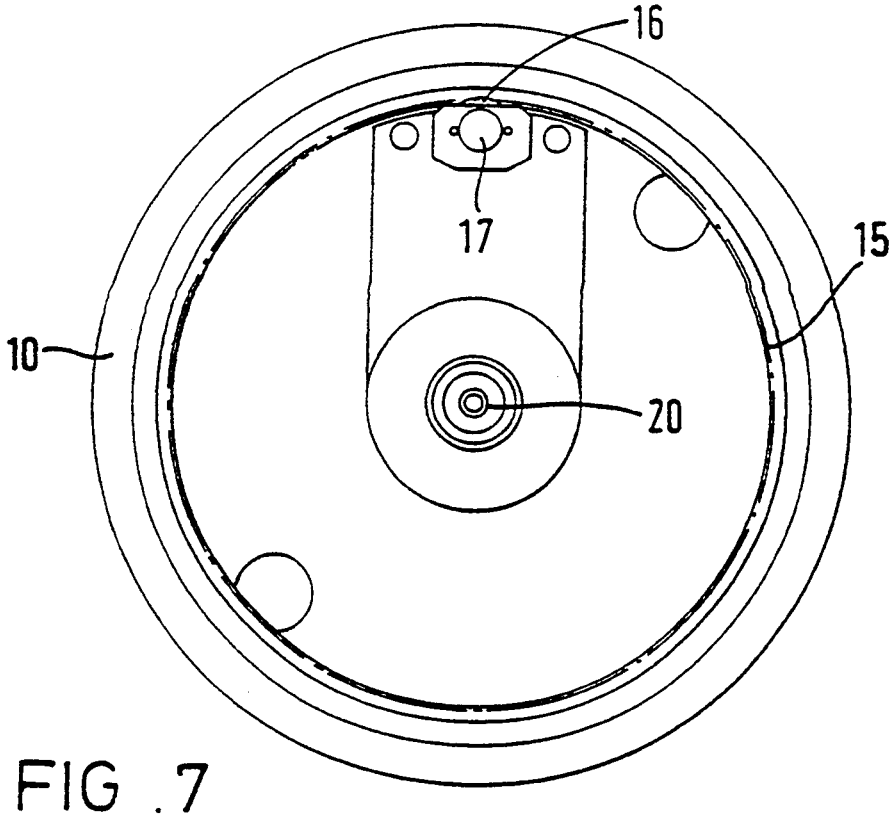
FIG. 7 shows in side view a modified reel.

FIG. 7 shows a further modified reel construction wherein the umbilical 5 is wound in a single helix between the appropriately spaced slide plates 9 and 10. This arrangement provides less accommodation for the umbilical for a given diameter but does prevent loosening of the turns. The construction shown embodies an inwardly facing gear ring 15 driven by a sprocket 16 on hydraulic motor 17.

There may be included a multi-turn potentiometer driven by or from the wheel to provide an electrical signal proportional to the length of umbilical paid out.

Figure 8:
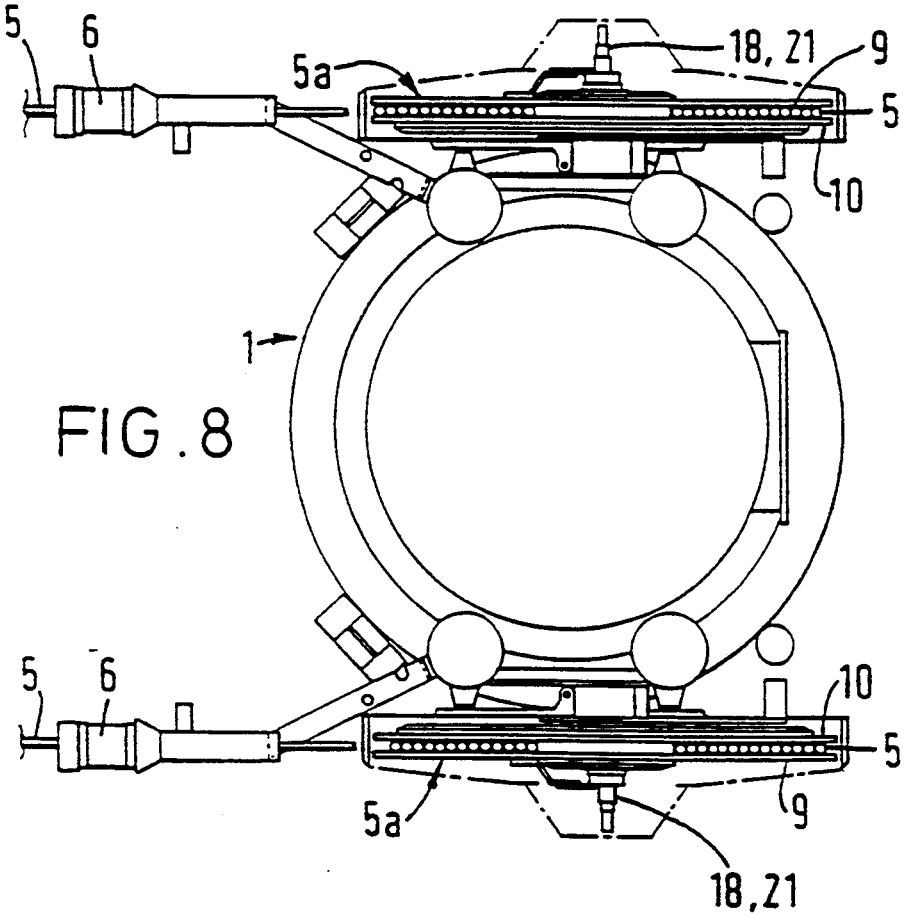
FIGS. 8 to 10 show respectively, plan, side and front elevations of a construction with two single layer winding reels.
Figure 9:
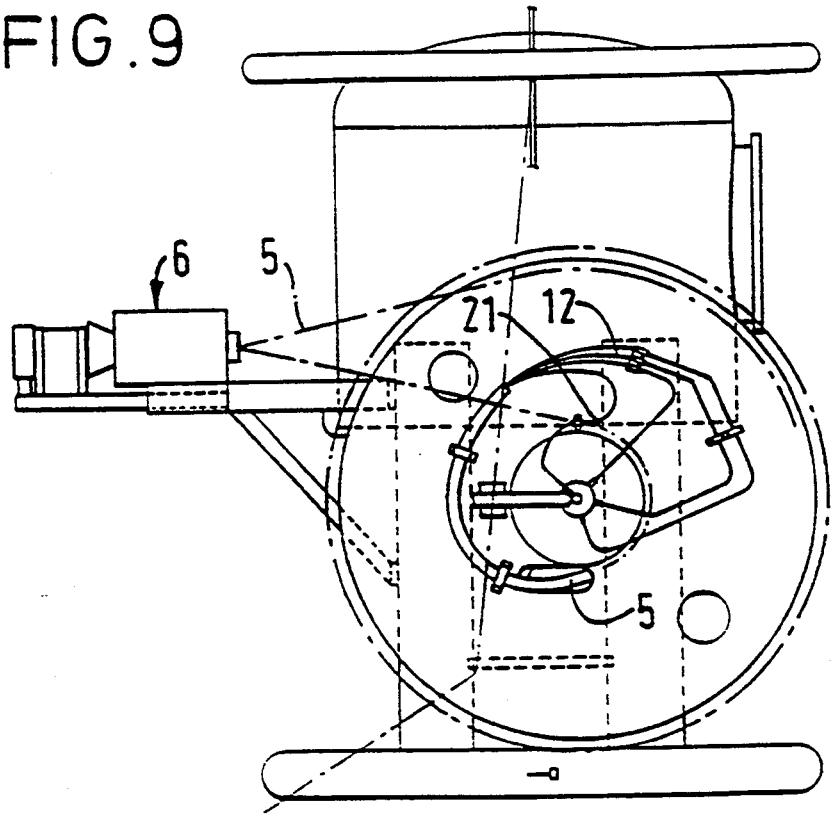
Figure 10:
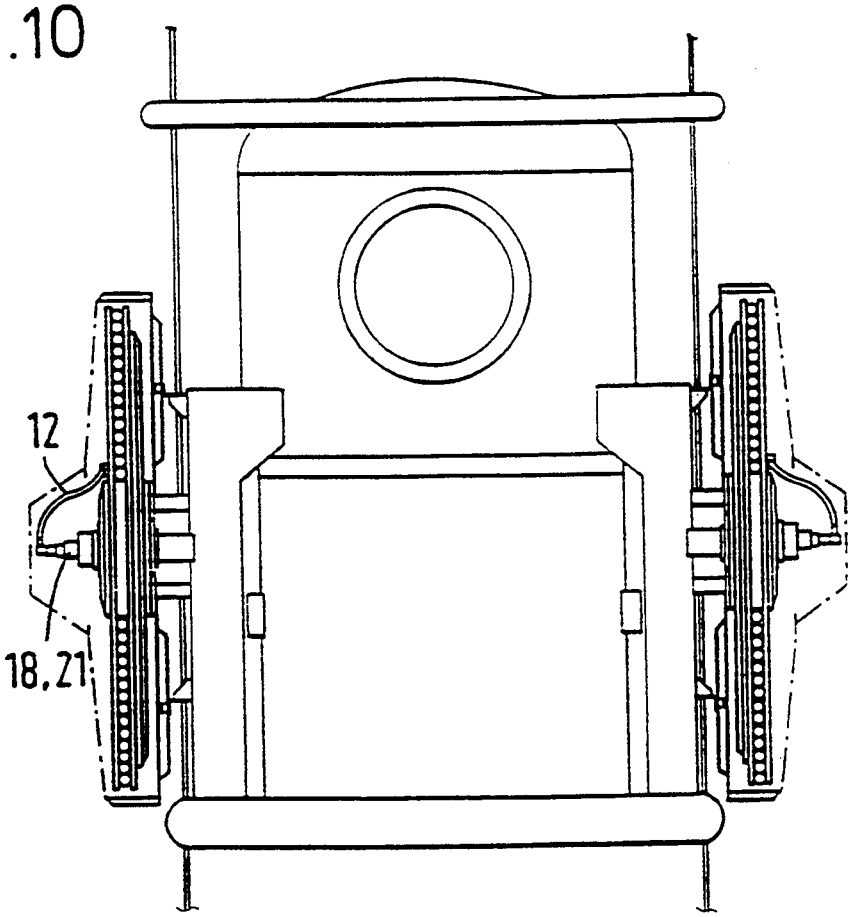

FIGS. 8 to 10 show the complete single turn umbilical reeling means fitted to a wet diving bell and indicates one preferred construction of a complete diving apparatus. Reference numerals designating the parts are as previously used. As may be seen from this construction, one advantage of the arrangement is that the reel containing the umbilical is positioned so that there is very little increase in size and volume of the overall diving apparatus and the reel is not an encumbrance to normal diving operations.

Figure 11:
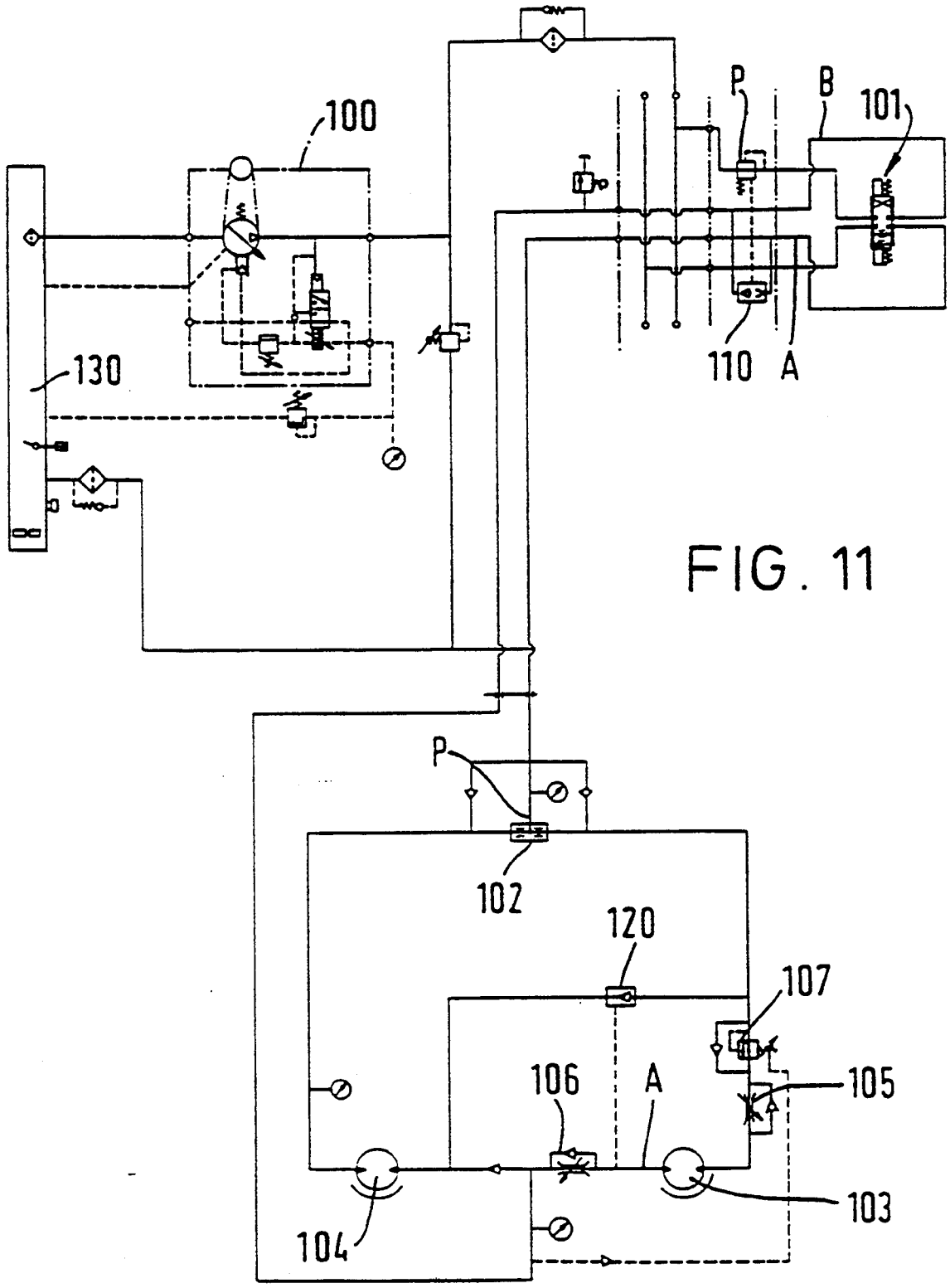
FIG. 11 shows a hydraulic circuit.

FIG. 11 shows an outline hydraulic circuit using variable/axial piston pump 100 with associated controlling valve gear. The output of the pump is fed to a reversing proportional valve 101 which in turn feeds via a flow divider 102, the main reel motor drive 103 and the fairlead motor drive 104. Each of the drives 103 and 104 has a respective relief valve system 105 and 106 which may serve to control torque such that the tractive or drag force between the main reel and the fairlead are substantially constant. A further important feature of the hydraulic circuit is that overtensioning of the umbilical is prevented by utilising torque limiting systems. In both the drawing-out of the umbilical and the reeling-in it has been found in practice that friction can become very heavy and for this reason it is a feature of this invention to provide drive to both the main reel and the fairlead but still maintaining an amount of tension through the torque control means to prevent spilling the umbilical from the reel.

The valve systems 105 and 106 further provide overload relief means operative to prevent excessive forces being applied to the umbilical if, for example, the diver is trapped or the umbilical is snagged.

To prevent reeling-in over-run beyond a certain point a rubber wedge may be secured to the umbilical to abut the fairlead and physically prevent further winding-in, thus stalling the motors and causing relief valves and 106 to operate.

The subsea umbilical wheels are powered by two hydraulic motors controlled by a hydraulic power pack on the support vessel, which controls the flow, pressure and direction of rotation.

On paying out of the wheel, both motors 103,104 are powered simultaneously to turn the reel and drive the fairlead, the fairlead being used to pay out the umbilical to the diver and prevent slack turns developing on the drum by keeping tension on the umbilical it all times.

On reeling in, only the main wheel turns to stow the umbilical with the fairlead motor free-wheeling under tension to apply drag to the umbilical tight on the drum at all times, with a restricted line pull to prevent diver injury.

On selecting direction of control oil flows from pump 100 through lines "P" and "A" of the proportional directional valve 101 to "P" port of the flow divider 102 where the oil is split 60/40% to fairlead 104 and wheel motor 103. The fairlead motor has priority on drive due to the sequencing valve 107 delaying pressure to the wheel motor 103 until the fairlead motor 104 is up to pressure and running, and then the sequence valve 107 opens giving drive to the wheel.

Speed of the wheel can also be controlled by adjustment of the speed control valve 106 to slow or speed up the wheel accordingly and also help in synchronisation of the fairlead drive should the wheel pay out too quickly. Oil then returns to port "B" of directional valve and back to the tank.

On recovering the umbilical, oil is selected between ports "P" and "B" of valve 101 and flows at a reduced line pressure, due to the relief valve 110, to limit the line pull to 50 kg at the bottom turn. The flow then enters port "A" of the wheel motor 103 and in turn opens the pilot check valve 120 to prevent cavitation of the fairlead motor 104.

From motor 103, oil enters the speed control valve 105 to control the speed of the wheel, if desirable, and then bypasses both 107 and 102 back to port "A" of 101 and finally back to tank 130.

A means may be provided to prevent over-run in the unwinding direction thus preventing the umbilical from being reverse wound should the limit switch fail to operate.

Although the embodiments described and shown with reference to the drawings use reels mounted in a vertical plane, it is equally possible to mount the reels in a horizontal or other plane should this be more convenient in any particular construction.

We claim:

1. An underwater deployment, retrieval and storage apparatus for an underwater umbilical, said apparatus comprising an underwater reel with spaced flanges to contain the underwater umbilical wound around a hub of the of the reel, a rotary union mounted in the hub having a fixed assembly about which the hub rotates, wherein the rotary union comprises a first unit providing underwater fluid line service connection for gases and liquids and a second unit integral therewith providing underwater electrical service and fibre optic connections, said fixed assembly receiving services from said service connections and feeding same to a rotatable assembly connected with the hub and coupling said services to one end of the umbilical, first drive means to rotate the reel, second drive means coupled with a fairlead for driving the umbilical for deployment and retrieval, and both said drive means being coupled and controlled so that a substantially constant tractive or drag force is exerted and maintained on the umbilical between the fairlead and reel during extraction from and rewinding onto the reel in an underwater environment.

2. An underwater apparatus according to claim 1, wherein the reel flanges are spaced to provide a monospiral winding.

3. An underwater apparatus according to claim 1 wherein the reel flanges are spaced to provide a multi-turn multi-layer winding.

4. An underwater apparatus according to claim 1, wherein the first and second drive means use hydraulic motors under remote control having extraction and rewinding control selection.

5. An underwater apparatus according to claim 1, wherein the first and the second drive means are controlled whereby, during extraction, the second drive means extracts the umbilical against the drag of the first drive means.

6. An underwater apparatus according to claim 1, wherein the first and the second drive means are controlled whereby, during rewinding, the first drive means retracts the umbilical against drag of the second drive means.

7. An underwater apparatus according to claim 1, wherein the first and second drive means comprise hydraulic motors in a hydraulic circuit giving proportional control with flow being divided between the first drive means and the second drive means.

8. An underwater apparatus according to claim 1, wherein the second drive means has a torque control system whereby the constant tractive force pulling against the first drive means is provided during extraction with a smaller tractive drag against the first drive means being provided during rewinding.

9. An underwater apparatus according to claim 1, including control means which adjusts, continuously the speed of, or torque applied to the reel according to the instantaneous wound umbilical diameter.

10. An underwater apparatus according to claim 1, wherein a mechanical pivoting arm stop means engages the reel at limit positions of extraction and rewinding of the umbilical.

11. An underwater apparatus according to claim 1, wherein the first drive means comprises a driven pinion engaging an annular gear track on one of the flanges of the reel.

12. An underwater apparatus in accordance with claim 1, wherein both the first and second drive means are operative both during extraction and during rewinding of the umbilical, the respective drive rates and torque applied through each drive means being arranged to maintain a traction in the umbilical between the fairlead and the reel.

13. An underwater apparatus according to claim 1, wherein the second drive means is effected by frictional engagement between a peripheral part of the umbilical and a linearly moving drive member.

14. An underwater apparatus according to claim 13 wherein the drive member comprises an endless belt extending between rollers, one run of the belt engaging the umbilical.

15. An underwater apparatus according to claim 14, wherein the belt has a concave surface profile engaging the umbilical.

16. An underwater apparatus according to claim 14, wherein the umbilical is pressed against the belt by rollers.

17. An underwater apparatus according to claims 14, wherein the drive member includes a second belt engaging and pressing against the umbilical in opposed relationship to the belt.

18. An underwater deployment, retrieval and storage apparatus for an umbilical, said apparatus comprising an underwater reel with spaced flanges to contain the underwater umbilical wound around a hub of the reel, a rotary union mounted in the hub having a fixed assembly about which the hub rotates, said fixed assembly receiving services and feeding same to a rotatable assembly connected with the hub and coupling said services to one end of the umbilical, first drive means to rotate the reel, second drive means coupled with a fairlead for driving the umbilical for deployment and retrieval, both said drive means being coupled and controlled so that a substantially constant tractive or drag force is exerted and maintained on the umbilical between the fairlead and reel, both during extraction from and rewinding onto the reel in an underwater environment, and including encoding means to determine the extracted length of the umbilical for drive control or monitoring purposes.

19. A marine diving bell including an underwater deployment and storage apparatus for an umbilical, said apparatus comprising at least one underwater reel with spaced flanges to contain the underwater umbilical wound around a hub of the reel, a rotary union mounted in the hub having a fixed assembly about which the hub rotates, said fixed assembly receiving line services for gases, liquids, electricity, and fiber optics, said line services being fed to a rotatable assembly connected with the hub, and coupling said services to one end of the umbilical, first drive means to rotate the at least one reel, second drive means coupled with a fairlead for driving the umbilical for deployment and retrieval, both said drive means being coupled and controlled so that a substantially constant tractive or drag force is exerted and maintained on the umbilical between the fairlead and the at least one reel, both during extraction from and rewinding onto the at least one reel in an underwater environment; and including encoding means to determine the extracted length of the umbilical for drive control or monitoring purposes.

20. A marine diving bell according to claim 19, wherein the at least one reel of said underwater deployment and storage apparatus is mounted to a side of a diving bell, the plane of the at least one reel being vertical.

21. A diving bell according to claim 19, wherein the at least one reel of said underwater deployment and storage apparatus is mounted below a diving bell, the plane of the at least one reel being horizontal.

* * * * *